US008793920B2

(12) United States Patent
Singh

(10) Patent No.: US 8,793,920 B2
(45) Date of Patent: Aug. 5, 2014

(54) GUNSIGHT WITH VISUAL RANGE INDICATION

(76) Inventor: Vijay Singh, Far Hills, NJ (US)

( * ) Notice: Subject to any disclaimer, the term of this patent is extended or adjusted under 35 U.S.C. 154(b) by 128 days.

(21) Appl. No.: 13/011,353

(22) Filed: Jan. 21, 2011

(65) Prior Publication Data

US 2012/0180367 A1 Jul. 19, 2012

Related U.S. Application Data

(60) Provisional application No. 61/432,934, filed on Jan. 14, 2011.

(51) Int. Cl.
*F41G 1/35* (2006.01)
*F41G 1/473* (2006.01)

(52) U.S. Cl.
CPC . *F41G 1/473* (2013.01); *F41G 1/35* (2013.01)
USPC ..... 42/115; 42/117; 42/146

(58) Field of Classification Search
CPC ..... F41G 1/34; F41G 1/345; F41G 1/35; F41G 1/36; F41G 1/473
USPC ..... 42/114, 115, 117, 142, 122, 130, 116, 42/146
See application file for complete search history.

(56) References Cited

U.S. PATENT DOCUMENTS

| | | | | | |
|---|---|---|---|---|---|
| 4,028,991 | A * | 6/1977 | Kuby | 89/41.03 |
| 4,616,421 | A * | 10/1986 | Forsen | 42/130 |
| 4,627,183 | A * | 12/1986 | Stuckman | 42/1.01 |
| 5,621,999 | A * | 4/1997 | Moore | 42/117 |
| 5,822,905 | A * | 10/1998 | Teetzel | 42/117 |
| 7,237,355 | B2 * | 7/2007 | Smith, III | 42/122 |
| D583,898 | S * | 12/2008 | Peters et al. | D22/109 |
| 7,594,352 | B2 * | 9/2009 | Holmberg | 42/124 |
| 7,743,547 | B2 * | 6/2010 | Houde-Walter | 42/146 |
| 2001/0045046 | A1 * | 11/2001 | Otteman | 42/136 |
| 2002/0178635 | A1 * | 12/2002 | Martin | 42/70.11 |
| 2009/0217565 | A1 * | 9/2009 | Ford | 42/114 |

* cited by examiner

*Primary Examiner* — Stephen M Johnson

(57) ABSTRACT

A laser beam generating module capable of projecting a series of concentric circles of light is connected to the frame of a firearm in substantial alignment with the gun barrel. The laser beam can be actuated on demand, and the resultant pattern will be projected onto the target. Due to the intrinsic fan angle of the spatially projected beams, the circles displayed on the target will appear to be spaced further apart when the target is further away, and appear to be spaced closer when the target is nearer. By selecting a suitable laser fan angle, it is possible to get an immediate visual indication of the approximate range to the target increasing the potential accuracy.

6 Claims, 4 Drawing Sheets

GUNSIGHT WITH VISUAL RANGE INDICATION

This application is a U.S. Patent Application that relies for priority under 35 U.S.C. 120 on Provisional Application Ser. No. 61/432,934 filed on Jan. 14, 2011, which is incorporated herein by reference.

BACKGROUND OF THE INVENTION

1. Field of the Invention

The present invention relates generally to weapons systems, and more particularly to firearms which include means for generating a laser beam as an aiming mechanism. It is well known in the firearms art to connect a means for generating a laser beam aligned to the barrel axis of the firearm as an aid to aiming the weapon to deliver a projectile substantially at the point where the laser beam intersects the target.

2. Statement of the Prior Art

Among law enforcement officers, these laser aiming devices are highly prized. Confrontations requiring the use of firearms rarely occur in broad daylight. Most police work which requires firearms occurs in poor lighting conditions, either indoors or outside. These poor lighting conditions make it difficult to use conventional optical gun sights effectively. Use of a laser aiming device requires the officer to merely point the firearm at the target so that a bright laser dot is projected onto the target. The intimidating effect on the violator on seeing the laser dot on his person is often sufficient to cause them to capitulate and reduce the potential for violence.

Prior art laser aiming devices often project a single laser beam or, in a few instances, a circle and a dot or a crosshair. This laser beam is usually red, but newer devices also use green lasers as these appear brighter to the eye. Means is provided to actuate the laser on demand, usually by a trigger switch, to avoid alerting the target to the location of the firearm, and also to conserve battery power. Means is also provided to align the laser to the firearm barrel axis.

The major drawback of prior art laser aiming devices is due to the fact that only a single laser beam is projected. A dot, usually red, will appear on the target at the point where the projectile will impact. This dot is the same size over a wide range of distance from the firearm to the target. In certain prior art, a circle or crosshair may be projected as a means to providing an indication of a supposed "splatter zone" based on the MOA (i.e., Minute of Angle or Minute of Arc).

As is well known, MOA is a unit of angular measurement used in the firearms industry on scopes or firearms to define shooting accuracy. It is popular because 1 MOA almost equals one inch (1.0472 inches to be more precise) at 100 yards. However, the person operating the firearm has no means of determining the range to the target. This is important, especially with handguns, where the firearm accuracy deteriorates rapidly with distance. Furthermore, poor lighting conditions and the heat of combat often make it difficult to see the small projected laser dot. Valuable seconds may be lost trying to determine exactly where the gun is pointing. Certain prior art laser aiming devices use a camera with a range finder to display the distance to the target. However, this is impractical for handgun use where a rapid response is essential.

Most confrontations with law enforcement occur at fairly close range (e.g., 10 to 30 feet). In many cases, the law enforcement officer needs to rapidly deploy his weapon and all he has time for is to point the weapon at the assailant. While laser-pointer type aiming devices are very useful in this "point and shoot" situation, they provide no means for the officer to judge distance to the target, and thus the relative accuracy of his shot. This is particularly difficult in poor lighting conditions where human depth perception is severely compromised. Obviously, in the aforementioned situation there is no time for the officer to use a conventional optical rangefinder to determine the distance to the target.

What is needed is a laser aiming device that combines the ease of use of a laser pointer gun sight with additional visual indication of range. Such a laser aiming device needs to work at relatively short ranges of 10 to 50 feet and not require substantial time to interpret. It should also be easily retrofitted to existing firearms and require minimal training.

SUMMARY OF THE INVENTION

These and other objects, advantages, and novel features are provided by embodiments of the present invention, which overcome all these difficulties and provides all the desired features by projecting a spatial laser light pattern comprising a series of concentric, closed plane shapes instead of a single beam. The projected spatial laser light pattern may be designed with a specific fan angle so that the projection appears bigger, the further away it is projected. With a projected spatial laser light pattern comprising concentric, closed plane shapes, the closed plane shapes will appear to be smaller and spaced closer together at short distances, and will appear wider and spaced further apart at longer distances. By the visual appearance of the projected spatial laser light pattern, the firearm user can instantly determine the approximate distance to the target and thus improve the potential accuracy of the shot.

The series of concentric, closed plane shapes may comprise circles, ellipses, or quadrilaterals such as rectangles and squares, or combinations thereof (e.g., a series of concentric circles and squares or a series of concentric ellipses and rectangles). For significantly improved depth perception, embodiments of the present invention may comprise a series (e.g., 3 or more) concentric circles to be projected. This, in effect, channels the shooter's eye to the center of the target. Projection of these circles, while superficially resembling a 2-dimensional bull's eye, is really perceived as a visual tunnel. For example, at a short distance to the target, the projected image on the target will be a series of very closely spaced circles, where the outermost circle will be small. But, if the target is further away, then the circles will be spaced further apart and the outermost circle will appear larger, giving an instantaneous visual cue as to the relative distance of the target from the shooter. This depiction subconsciously cues the shooter as to the approximate distance to the target, perhaps by producing the illusion of a narrow (i.e., short) tunnel, or of a wide (i.e., long) tunnel. A center dot may be provided as an aid for aiming the firearm towards the exact center of the tunnel. The center dot is a matter of preference and not essential in itself to the invention.

Furthermore, in a stressful low light confrontation, the spatial laser light pattern of concentric circles enables the operator of the firearm to acquire the target much faster than prior art single dot laser pointer gun sights, potentially giving the shooter a tactical advantage.

The fan angle of the spatial laser light pattern of concentric circles may also be adjusted to match the shot spread pattern of specific firearms.

BRIEF DESCRIPTION OF THE DRAWINGS

The foregoing and other features of the present invention will become more apparent from the following description of exemplary embodiments, as illustrated in the accompanying drawings wherein.

DETAILED DESCRIPTION OF THE EMBODIMENTS

Exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. Persons of ordinary skill in the relevant art will recognize that other components and configurations may be used without departing from the true spirit and scope of the embodiments. It is to be understood that each specific element includes all technical equivalents that operate in a similar manner to accomplish a similar purpose. Therefore, the examples and embodiments described herein are non-limiting examples.

Figure 1:
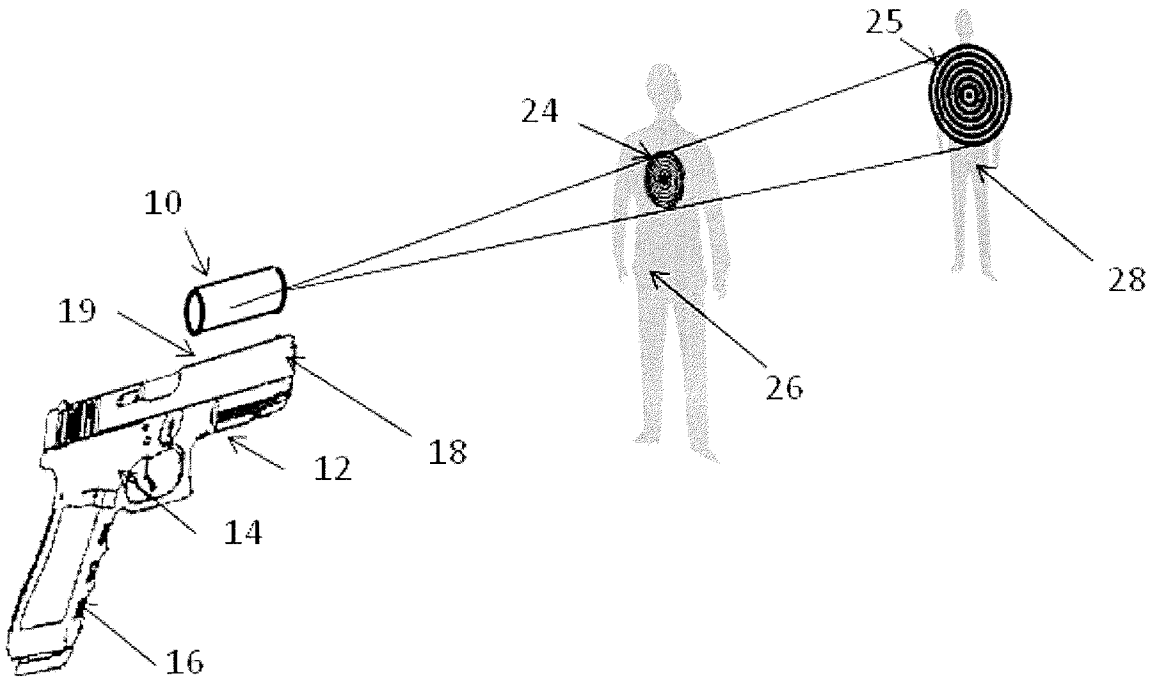
FIG. 1 is a perspective view of an aiming device mounted on a firearm to project a spatial laser light pattern onto a target in accordance with one embodiment of the present invention.

Referring now to the drawings, wherein like reference numbers generally indicate identical, functionally similar, and/or structurally similar elements, there is shown in FIG. 1 an aiming device 10 according to one embodiment of the present invention.

Aiming device 10 may, as shown in FIG. 1, comprise a laser gun sight for installation on a firearm 12, typically a handgun. However, it may also comprise a sight for use on a shotgun, rifle, or archery bow. It generally comprises a module capable of projecting a spatial laser light pattern, means for mounting the laser module in substantial axial alignment with the barrel of the firearm 12, a power source, and a switch to actuate the module.

In this embodiment, the laser module is adapted to be attached to a mounting means such as a Picatinny rail 19 that is affixed to the barrel 18. The Picatinny rail 19 (also known as a MIL-STD-1913 rail or STANAG 2324 rail or a "Tactical Rail") is a bracket used on some firearms in order to provide a standardized mounting platform. It facilitates quick mounting of the laser module without requiring realignment. Use of a Picatinny rail facilitates moving the device to different firearms, though any suitable method of attaching the module in substantial axial alignment to the firearm barrel is acceptable. A similar system is the Weaver rail, which uses a pair of parallel rails and several slots perpendicular to such rails.

One difference between the Picatinny rail and the Weaver rail is the size of these slots, although many rail-grabber-mounted accessories can be used on either type of rail. Weaver rails have a slot width of 0.180 in (4.572 mm), but are not necessarily consistent in the spacing of slot centers. The Picatinny locking slot width is 0.206 in. (5.232 mm) and the spacing of slot centers is 0.394 in. (10.008 mm). Because of this, with devices that use only one locking slot, Weaver devices will fit on Picatinny rails, but Picatinny devices will not always fit on Weaver rails. The other difference is that Weaver rails are continuous, while Picatinny rails are cut by the slots (i.e., like a dotted line) to neutralize expansion caused by barrel heating.

An actuation means or switch 14 is mounted on the side of the hand grip 16 so that the laser can be actuated by side pressure of the trigger finger. This is a common setup used with conventional single beam laser gun sights. Switch 14 can be mounted on either side to accommodate left or right handed users. Other means of actuation, such as tilt sensors or trigger mounted switches could also be used. The power source or battery 20 may be mounted in the rear of the laser module 10, although it could easily be placed elsewhere on the firearm 12. When the laser is actuated using switch 14, a spatial laser light pattern is projected. The projection 24 can be seen on the target 26. In this embodiment, the projected pattern is a series of concentric circles with a center dot. If the target is further away, as depicted by 28, then only a portion of the pattern 25 is seen on the target indicating to the user that the target is further away and accuracy of the resultant shot would be greatly reduced. The large size of the projection ensures that it is easy to quickly locate the aiming point in a combat or law enforcement situation. The large projected image onto the target is also is a deterrent to violence as the target can see that he/she is well within lethal range of the firearm and should surrender peacefully.

Figure 2:
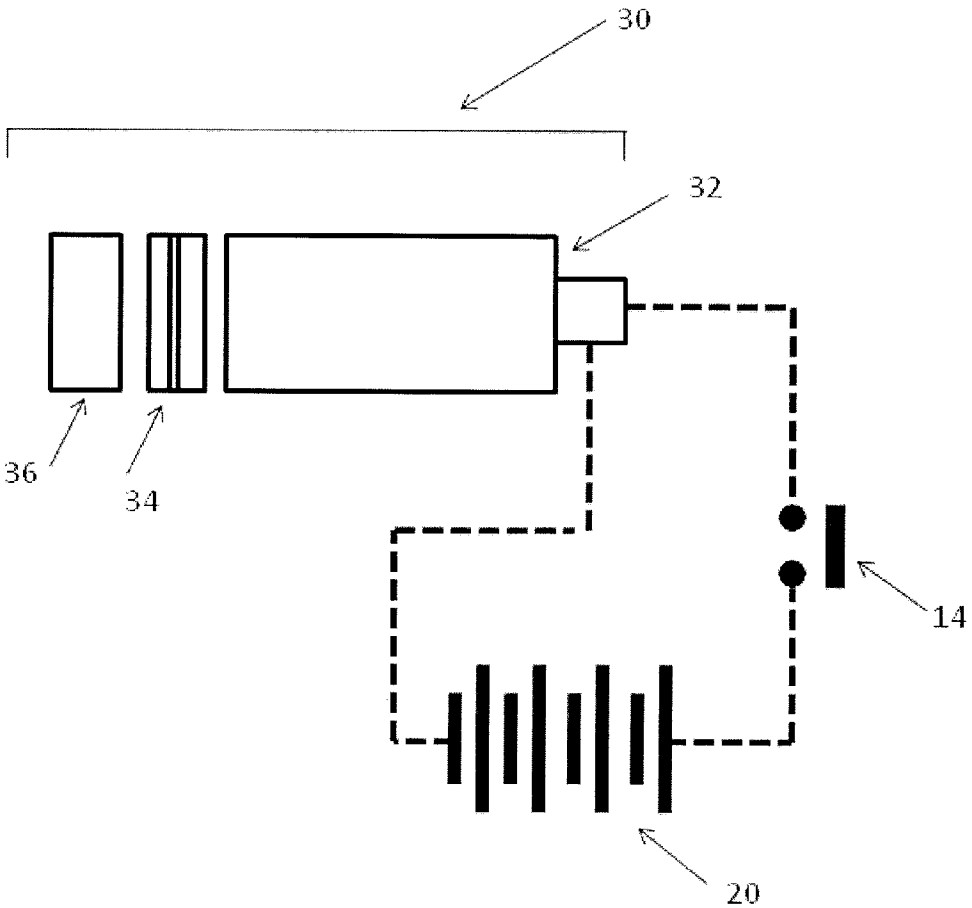
FIG. 2 is schematic view of the various components of the aiming device shown in FIG. 1.

FIG. 2 shows a detail of the laser gun sight. Laser pattern generator 30 suitably comprises a Lasiris™ SNF, Model 507C, which projects 7 concentric circles and is manufactured by Coherent Inc. of Montreal, Canada. It contains a laser diode 32, a diffraction grating 34, and a focusing lens 36 to generate a focused projected laser pattern. The laser diode 32 has a power output of about 10 mW, which has been found to be satisfactory for a desired projection distance of up to 50 feet in both indoor and low light conditions. Modules with higher output power (up to 200 mW) are available if more range is needed, or if the device is intended for use in broad daylight.

Figure 3:
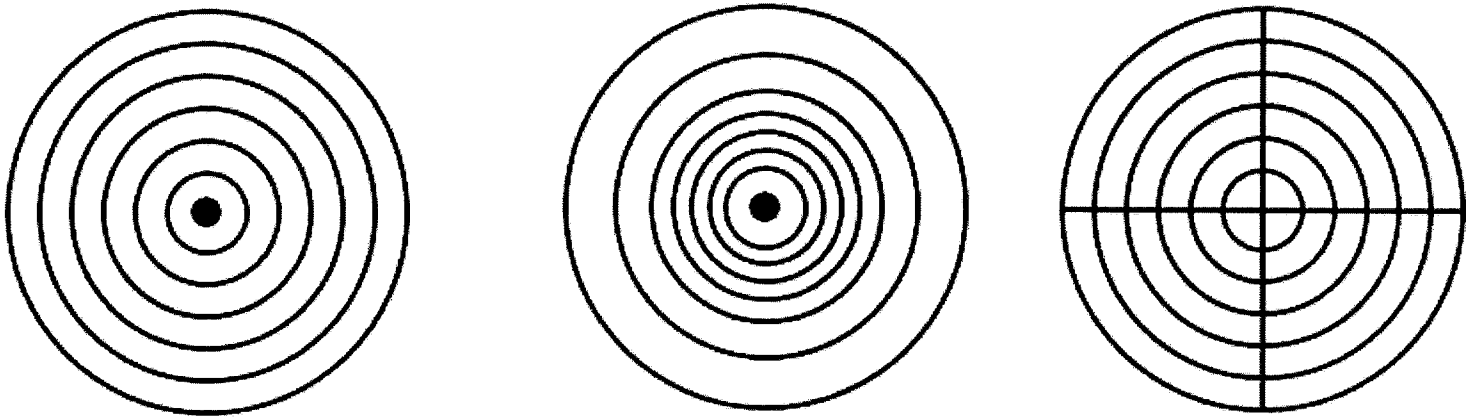
FIG. 3 is front view of projected spatial laser light patterns that may be used with the aiming device shown in FIG. 1.

The diffraction grating 34 generates the desired spatial light pattern. Many patterns are possible as shown in FIG. 3, including rectangular grids and dot matrices. Other custom designs can be produced by simply changing the diffraction grating. In the preferred embodiment, diffraction grating 34 was selected to generate a pattern of 7 concentric circles plus a center dot. This has been found to be a presently preferred embodiment of the invention. The concentric circle pattern provides instant feedback of depth perception and with a few hours of training users can judge the distance to the target by just flashing the concentric circle projection. The concentric circles are also intuitive as they superficially resemble a bull's eye target that is familiar to all shooters. The center dot provides an aim point consistent with existing single dot laser gun sights, thus facilitating the transition from conventional single dot laser point type gun sights. Lens 36 can be adjusted to focus a sharp image of the concentric circles at the desired range. In one embodiment, this was set to be in focus from 10 to 30 feet.

In the preferred embodiment, a red laser (i.e., 635 nm wavelength) was used. A green laser (i.e., 532 nm wavelength) would be even better as the human eye perceives higher brightness at the lower wavelength for the same laser power output.

Figure 4:
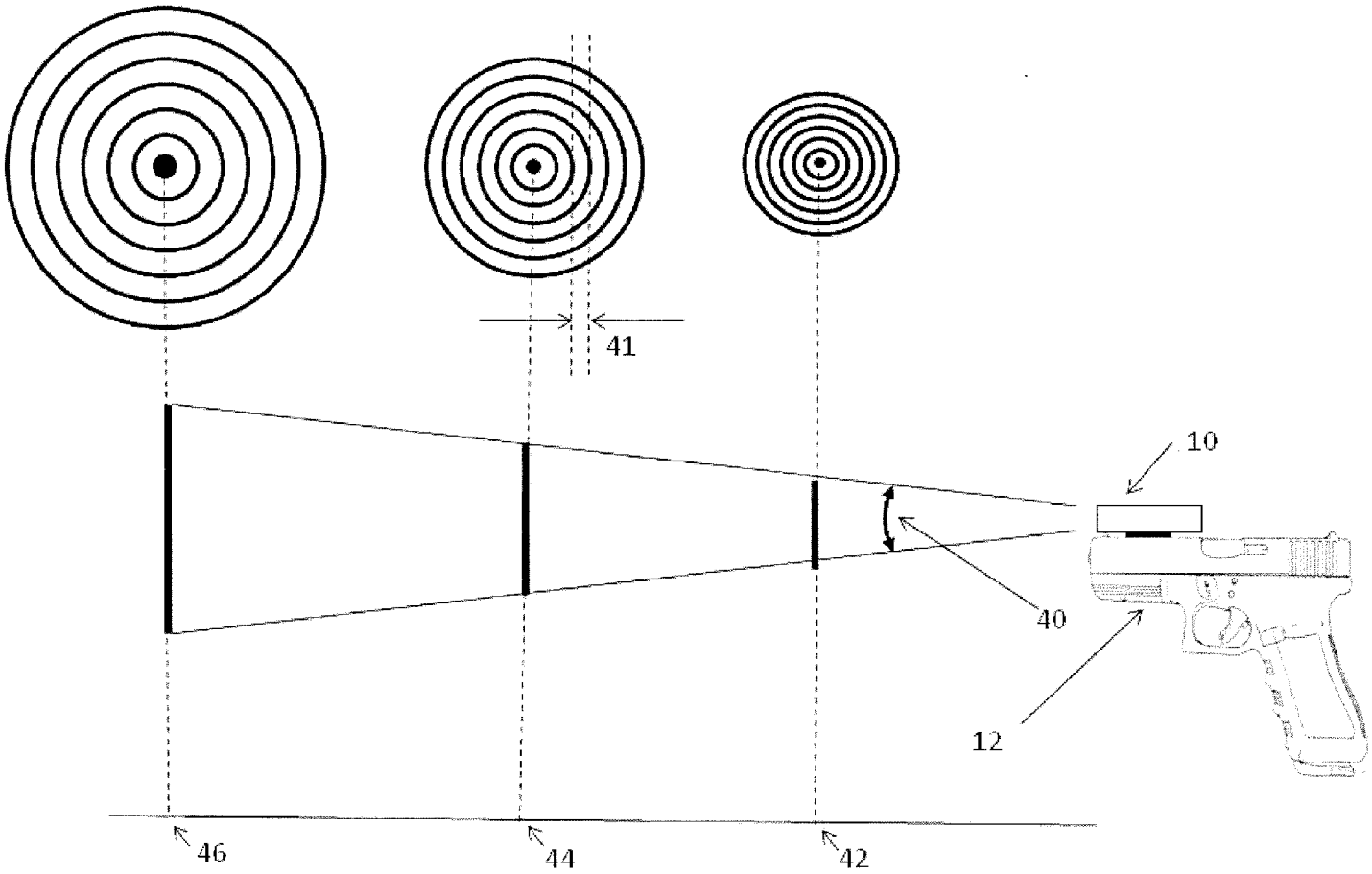
FIG. 4 is a side view of an illustrative projected spatial laser light pattern at various distances from the firearm.

FIG. 4 shows how the beam diverges with distance from the laser gun sight. In the preferred embodiment, the fan angle 40 was 1 degree. With this fan angle, the innermost circle appears to be about 2 inches wide at position 42 (i.e., a distance of about 10 feet) and the spacing between the concentric circles or"intercircle spacing" is about 1.5 inches. Again, with a 1 degree fan angle, the innermost circle appears to be about 5.5 inches wide at position 44 (i.e., a distance of about 20 feet) with an intercircle spacing 41 of about 2 inches. Finally, with a 1 degree fan angle, the innermost circle appears to be about 8.3 inches wide at position 46 (i.e., a distance of about 30 feet) with an intercircle spacing of about 4.3 inches. So, with this selected fan angle of 1 degree, the visual range of the sight is from about 5 to 30 feet. This roughly corresponds to the practical useful range of a handgun under real world conditions. Other fan angles (e.g., from about 0.1 to about 2 degrees) can be selected to adjust the sight to longer ranges.

It is, thus, possible for the user to estimate the distance to the target from the apparent size and intercircle spacing of the projected spatial laser light pattern onto the target. With minimal training this perception of distance becomes intuitive and is performed subconsciously. This distance estimation technique based on the apparent size and intercircle spacing of the projected pattern works exceptionally well in poor lighting conditions where the human eye is not capable of significant depth perception due to lack of visual cues.

In the preferred embodiment, the interbeam angle between circles was 0.77 degrees. This affects the spread of the concentric circles around the innermost circle. This coupled with the fan angle can be used to adjust the projected pattern of circles for different overall size of the projected circles as well as the intercircle spacing.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for caring out this disclosure.

What is claimed is:

1. A weapon system, comprising:

a weapon; and a laser module for aiming said weapon, wherein said laser module is mounted on said weapon and adapted to project a spatial laser light pattern on a target that provides a user of the weapon system a visual indication of range to the target;

wherein said spatial laser light pattern is projected at a predetermined fan angle and wherein said predetermined fan angle comprises from about 0.1 to about 2 degrees.

2. The weapon system according to claim 1, wherein said predetermined fan angle comprises 1 degree.

3. A weapon system, comprising:

a weapon; and a laser module for aiming said weapon, wherein said laser module is mounted on said weapon and adapted to project a spatial laser light pattern on a target that provides a user of the weapon system a visual indication of range to the target, and wherein said laser module further comprises:

a laser diode;

a diffraction grating; and a focusing lens to generate a focused spatial laser light pattern.

4. The weapon system according to claim 3, wherein said laser diode comprises a red laser diode.

5. The weapon system according to claim 3, wherein said laser diode comprises a green laser diode.

6. The weapon system according to claim 3, wherein said focusing lens is adapted to generate a focused spatial laser light pattern at a distance of up to about 100 feet.

* * * * *